US009392844B1

(12) United States Patent
Burrell

(10) Patent No.: US 9,392,844 B1
(45) Date of Patent: Jul. 19, 2016

(54) COMPOSITE FOOTWEAR HAVING A PROGRAMMABLE VISUAL DISPLAY

(71) Applicant: Howard Burrell, Huntsville, AL (US)

(72) Inventor: Howard Burrell, Huntsville, AL (US)

( * ) Notice: Subject to any disclaimer, the term of this patent is extended or adjusted under 35 U.S.C. 154(b) by 512 days.

(21) Appl. No.: 13/945,640

(22) Filed: Jul. 18, 2013

(51) Int. Cl.

| | |
|---|---|
| ***A43B 23/24*** | (2006.01) |
| ***A43B 1/00*** | (2006.01) |
| ***A43B 3/00*** | (2006.01) |
| ***A43B 11/00*** | (2006.01) |
| ***A43B 23/02*** | (2006.01) |
| ***A43B 23/26*** | (2006.01) |

(52) U.S. Cl.
CPC ..... *A43B 23/24* (2013.01); *A43B 1/0054* (2013.01); *A43B 3/0005* (2013.01); *A43B 3/0015* (2013.01); *A43B 3/0021* (2013.01); *A43B 11/00* (2013.01); *A43B 23/023* (2013.01); *A43B 23/0245* (2013.01); *A43B 23/26* (2013.01)

(58) Field of Classification Search
CPC .... A43B 1/0054; A43B 3/0005; A43B 3/001; A43B 3/0015; A43B 3/0021; A43B 7/04; A43B 11/00; A43B 23/023; A43B 23/0245; A43B 23/24; A43B 23/26; A43C 11/00
USPC ..... 36/137, 138
See application file for complete search history.

(56) References Cited

U.S. PATENT DOCUMENTS

| | | | | |
|---|---|---|---|---|
| 3,058,241 | A * | 10/1962 | Rigsby | 36/97 |
| 5,839,210 | A * | 11/1998 | Bernier et al. | 36/50.1 |
| 5,926,978 | A * | 7/1999 | Smith | 36/101 |
| 8,056,269 | B2 * | 11/2011 | Beers et al. | 36/137 |
| 8,499,474 | B2 * | 8/2013 | Kaufman | 36/50.1 |
| 2011/0197475 | A1 * | 8/2011 | Weidl et al. | 36/107 |
| 2014/0373395 | A1 * | 12/2014 | White | 36/137 |

* cited by examiner

*Primary Examiner* — Ted Kavanaugh

(57) ABSTRACT

Novel footwear is disclosed. The footwear includes two deployable sidewalls, a deployable tongue and heel section. In the preferred embodiment, these all are equipped with telescoping rails and when in the deployed position allow the user to put on the shoe without laces. When in use, the deployable sections are fastened with an electromagnetic seal. On the tongue is a display, made up of LED or OLED elements, which may also include solar cells to power the internally stowed rechargeable battery. The upper section of the shoe is preferably made from a composite carbon fiber, or of aluminum, and contains a plurality of through apertures for ventilation and breathability.

17 Claims, 7 Drawing Sheets

COMPOSITE FOOTWEAR HAVING A PROGRAMMABLE VISUAL DISPLAY

BACKGROUND OF THE INVENTION

1. Field of the Invention

The present invention relates generally to footwear and, more specifically, to footwear substantially comprised primarily of carbon fiber and aluminum, preferably recycled aluminum, forming the body of the shoe that incorporates a power source, electronic circuits and a plurality of selectively illuminable lighting and/or display elements.

The body of the shoe has an outsole and an upper, the upper primarily made of the aforementioned carbon fiber and recycled aluminum and includes a plurality of deployable shoe-body sections that are movable from a seated (wearing) position to an open position that enables the user to place their foot within the shoe and wherethen the sections are slotted back to their seated or closed positions.

The deployable sections include left and right quarter sections, a heel quarter section and a vamp section, each of which having at least one rail extending from its respective section into the body of the shoe to allow each section to be controllably moved back and forth from the seated to the open position and back again. Preferably each deployable section has a pair of these rails spaced apart on opposing sides of each of the sections. Each rail has a catch on its distal end that mates with a pair of corresponding receptacles in both the seated and the deployed positions. These catches could be of many types, such as a mating nub and dimple that will securely hold the individual deployable section in its closed seated position and serve as a stop in its open position.

Furthermore, the footwear of the present invention provides for an additional latching mechanism comprising an electromagnetic lock between the footwear body and each of the deployable sections with an actuator for selectively engaging and disengaging each or all of them.

Positioned peripherally and located approximately between the upper and the outsole are a plurality of illuminable lighting elements, such as LEDs or OLEDs that are in communication with an electronic circuit so that users can either enable or disable this illumination and, optionally, vary the display color. The heel area also provides for illuminable elements that may activate either through pressure transmitted to the heel while walking or be powered continuously through a switch. The vamp also may provide an OLED display in communication with electronic circuits, this display would preferably incorporate microprocessors and components that would enable WIFI and Bluetooth communication, or the like, for displaying messages, information, entertainment, etc. on the display transmitted from or through a mobile device, such as a cell or "smart" phone.

Power to the display, electromagnetic locks, and various illuminable elements is provided through a rechargeable battery, preferably located in the heel area of the footwear and could be either superseded or supplemented by solar cells positioned beneath the OLED display or on the upper sections of the shoe body.

Circuit leads run through an aluminum tubing framework extending between the vamp OLED display, the various illuminable elements and power supply. The aluminum framework for the circuit leads is positioned between the outsole and insole, and may be incorporated in the lining of the shoe.

2. Description of the Prior Art

There are other shoes and types of footwear designed with various displays, ornamentation, and fastening mechanisms. While these articles of footwear may be suitable for the purposes for which they were designed, they would not be as suitable for the purposes of the present invention, as hereinafter described.

SUMMARY OF THE PRESENT INVENTION

A primary object of the present invention is to provide an article of footwear having an outsole and upper section with the upper manufactured primarily from recycled aluminum and/or carbon fiber with deployable sections that are extendable and retractable enabling the user to put the shoes on and take them off.

Another object of the present invention is to provide an article of footwear wherein the deployable sections include a left and right quarter section, a heel quarter section, and a vamp section.

Yet another object of the present invention is to provide an article of footwear wherein each of the deployable sections has at least one rail whereby the respective deployable section can be selectively moved from a closed state to an open state and then back to a closed state.

An additional object of the present invention is to provide an article of footwear wherein each of the rails extends from a respective deployable section into the body of the shoe either between the lining and vamp or between the insole and outsole.

A further object of the present invention is to provide an article of footwear wherein each of said rails has a latching mechanism comprising a catch on its distal end that mates with a corresponding deployed catch receptacle and seated catch receptacle within the body of the footwear that securely holds the respective deployable section in its closed seated position and in its open position when deployed.

A yet further object of the present invention is to provide an article of footwear having an additional latching mechanism comprising at least one switchably powered electromagnet positioned between its respective deployable section and the body of the shoe.

Another object of the present invention is to provide an article of footwear incorporating an actuator for engaging and disengaging said electromagnets.

Yet another object of the present invention is to provide an article of footwear wherein at least one of said deployable sections has an LED or OLED display on the exterior section of the deployable section.

Still yet another object of the present invention is to provide an article of footwear wherein said power source is at least one rechargeable battery incorporated into the body of the shoe.

An additional object of the present invention is to provide an article of footwear wherein the power source may include a plurality of solar cells in electrical communication with the rechargeable battery.

A yet further object of the present invention is to provide an article of footwear having a plurality of micro perforations that provide for venting and that increase the breathability of the shoe.

Additional objects of the present invention will appear as the description proceeds.

The present invention overcomes the shortcomings of the prior art by providing an article of footwear having an upper manufactured primarily from carbon fiber and aluminum with deployable section forming a unique means of pedial attachment where the deployable section are moveable between a closed position to an open position allowing the user to put their foot in the throat of the shoe wherethen the deployed sections are moved to their closed position thereby encompassing the user's foot. Also provided are illuminable elements arrayed around the footwear and a display for exhibiting graphics.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is an illustrative view of the footwear of the present invention in use.

FIG. 2, shown is a side view of the present invention.

DESCRIPTION OF THE REFERENCED NUMERALS

Figure 1:
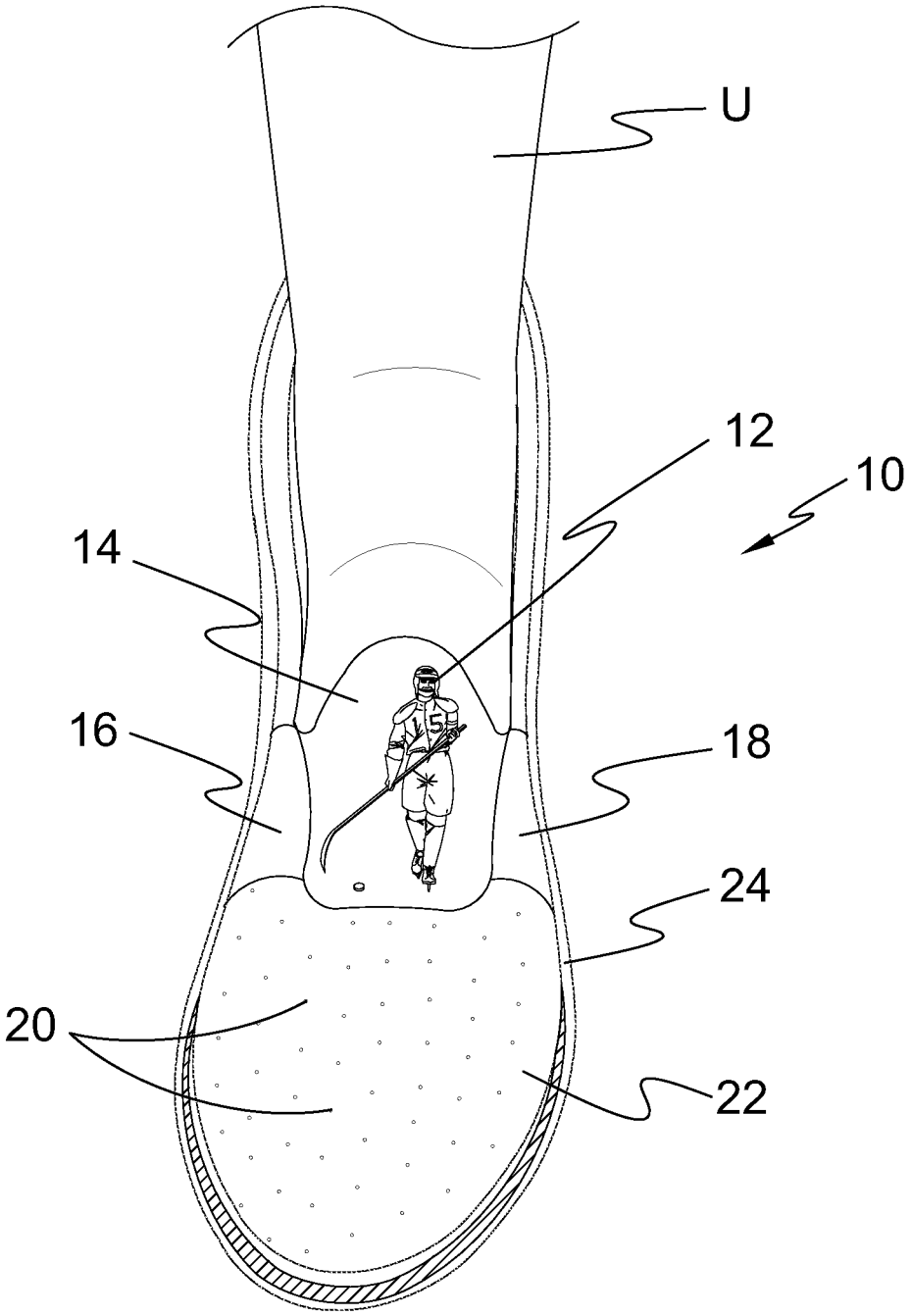

Turning now descriptively to the drawings, in which similar reference characters denote similar elements throughout the several views, the figures illustrate the use of the present invention. With regard to the reference numerals used, the following numbering is used throughout the various drawing figures.

10 footwear
12 display
14 deployable tongue
16 first deployable sidewall
18 second deployable sidewall
20 aeration apertures
22 upper section
24 outsole
26 peripheral LED units
28 deployable heel section
30 solar cells
32 battery compartment
34 rechargeable battery
36 telescopic rails
40 carbon fiber/aluminum section
42 SD card/port
44 transceiver
46 D/A converter
48 speaker
50 electromagnetic switch
52 processor
54 memory
56 storage
58 rail receiving apertures
U user
T footwear throat
M electromagnets

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the footwear 10 of the present invention in use. Shown is the footwear 10 of the present invention having an outsole 24, an upper section 22, a first deployable sidewall 16 on the left side of the upper 22, a second deployable sidewall 18 on the right side of the upper 22, and a deployable tongue 14 with a display 12 attached thereto located on the top side of the upper 22, as will be discussed further below. The footwear further provides micro ventilation aeration holes or apertures spread over and through the surface of the upper 22 and indicated at 20 for breathability, LED lighting, a microprocessor, a transceiver, an OLED display, solar cells, a battery power source and firmware for color display options. These will be discussed in detail further below.

Figure 2:
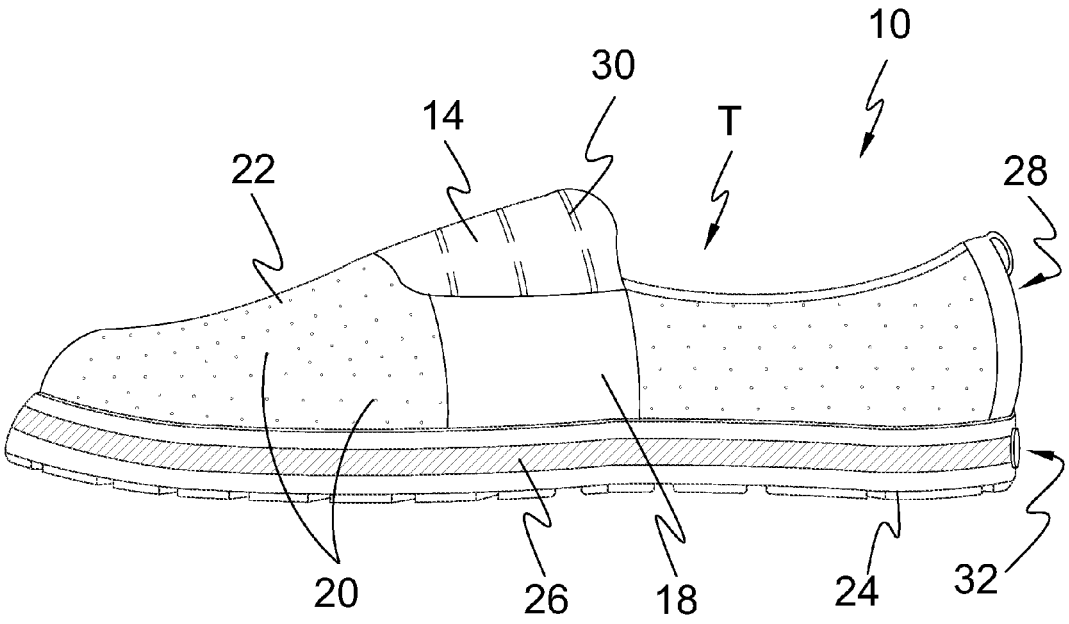

Referring to FIG. 2, shown is a side view of the present invention. The footwear 10 of the present invention has an outsole 24 and an upper 22 and incorporates deployable sections (indicated at 14 and 18 in this Figure) that enable the user to place their foot in the footwear throat T and then close the same deployable sections thereby encompassing the foot. This will be illustrated more clearly in FIG. 3. Also shown are peripheral LEDs 26 (or other illumination devices) and the contemplated location of solar cells 30 that would supplement the rechargeable battery 38 located in the battery compartment 32.

Figure 3:
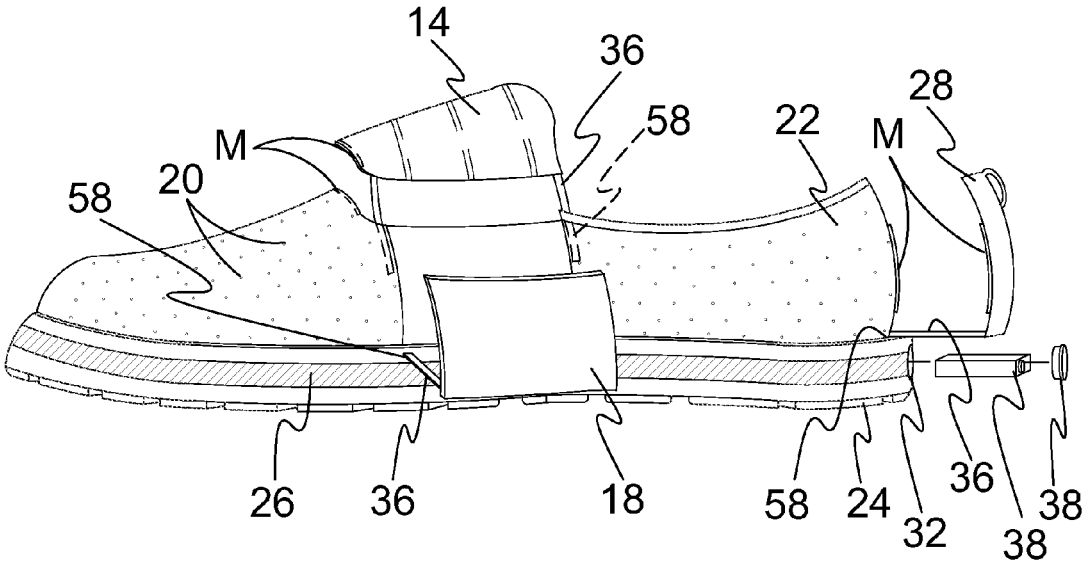
FIG. 3 is a side view of the footwear of the present invention.

Referring to FIG. 3, shown is a side view of the footwear 10 of the present invention. In this Figure, the deployable sections shown are second deployable sidewall 18 and deployable tongue 14. Additionally shown in the deployed position is the heel section 28. These sections deploy to the opened positions shown via telescopic rails 36 to allow the user U to place their foot in the shoe wherethen the deployable sections involved are moved to their seated position as seen in the previous Figures. The telescopic rails are received in rail receiving apertures 58 seen in the Figure. In the preferred embodiment seen herein, two sets of the receiving apertures are located in the lateral sides of the outsole 24 and another set in the heel section of the outsole 24 and the other sets in the upper section 22. Note also the rechargeable battery 34 and the battery compartment cap 38, which secures the battery 34 in compartment 32. The footwear 10 further provides rail latching on the telescopic rails 36 that is preferably made up of a resilient mating nub and dimple disposed such that the deployable sections 14, 16, 18, and 28 are latchingly engaged and held in both the seated and the open positions. Further provided are electromagnets M for each of the sections that will prevent inadvertent opening of the respective section until released by the user through an actuator.

Figure 4:
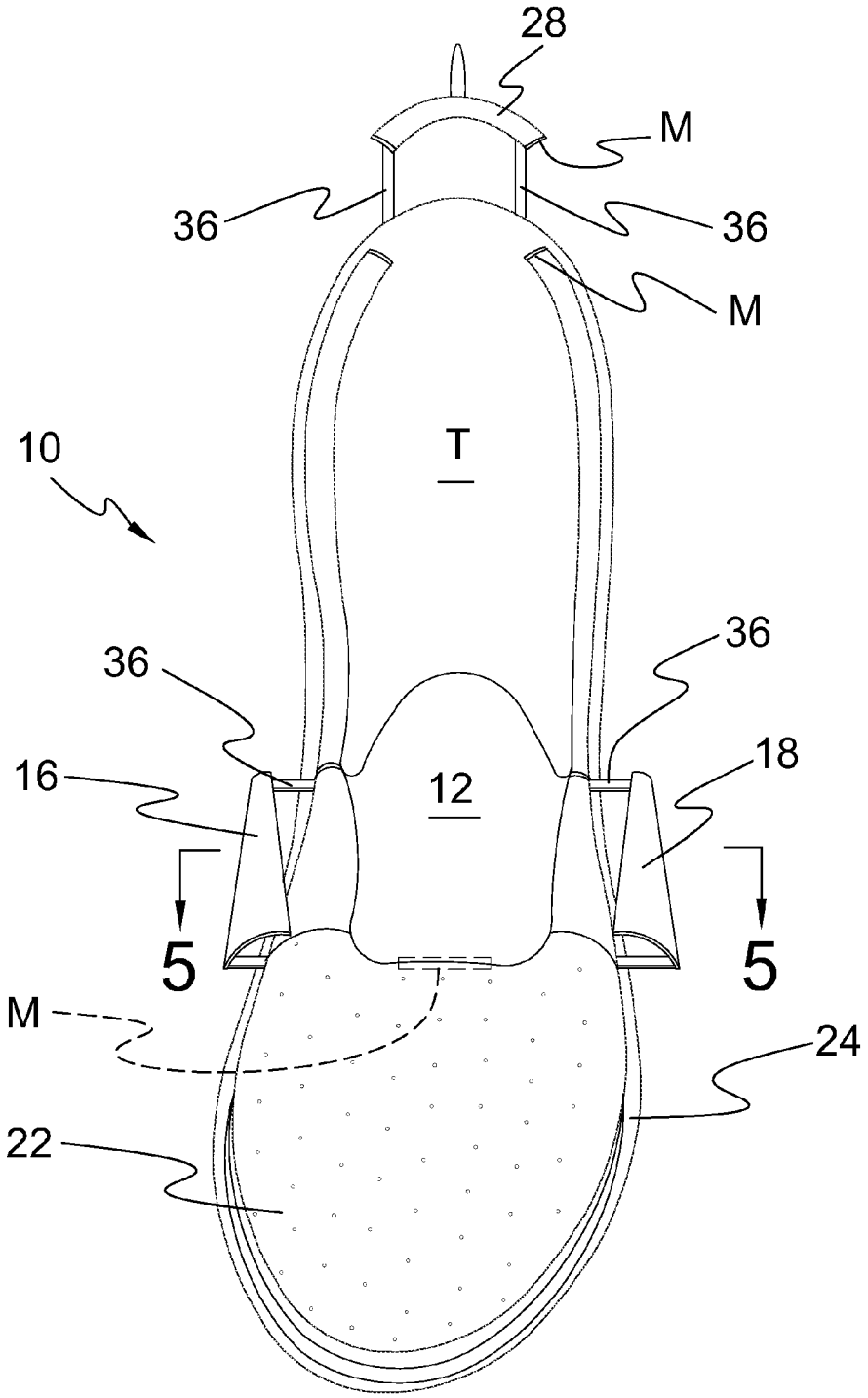
FIG. 4 is a top view of the present invention.

Referring to FIG. 4, shown is a top view of the present invention. Shown is the foot apparel 10 of the present invention having a housing that includes telescopic rails 36 sliding out to deploy first and second sidewalls 16, 18 respectively, that, along with the deployable tongue 14 with its corresponding rails (seen in FIG. 3) allows the user to insert their foot into the footwear 10 throat T and secure the improved footwear 10 to the feet without the use of shoelaces.

Figure 5:
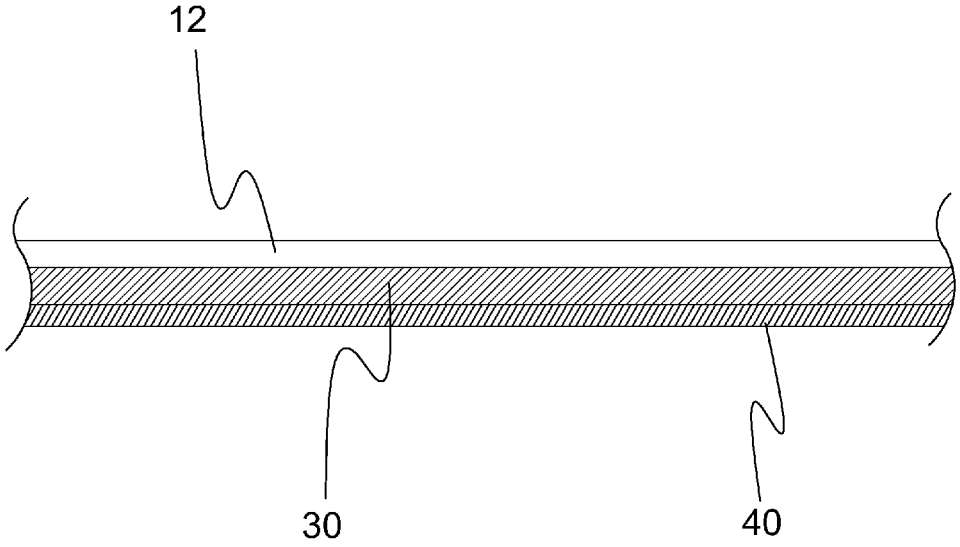
FIG. 5 is a partial sectional view of the deployable vamp section of the footwear of the present invention taken along the line 5-5 in FIG. 4.

Referring to FIG. 5, shown is a partial sectional view of the deployable vamp section of the footwear of the present invention as taken along line 5-5 of FIG. 4. In this partial view can be seen the contemplated carbon composite fiber section 40 of the invention which could, of course, be interspersed with various elastic materials for various degrees of flexibility, which would then form a rigid (or semi-rigid) structure to support the solar cells 30 and an OLED or other like display device 12 for exhibiting graphic images. Additional contemplated materials that could be used in the manufacture of the novel footwear 10 of the present invention are aluminum derived from recycling that would be mixed or otherwise disposed with elastic or semi-elastic material to form the shoe body. Aluminum, of course, comes to mind because of its light weight, easy availability, and its relatively low cost.

Figure 6:
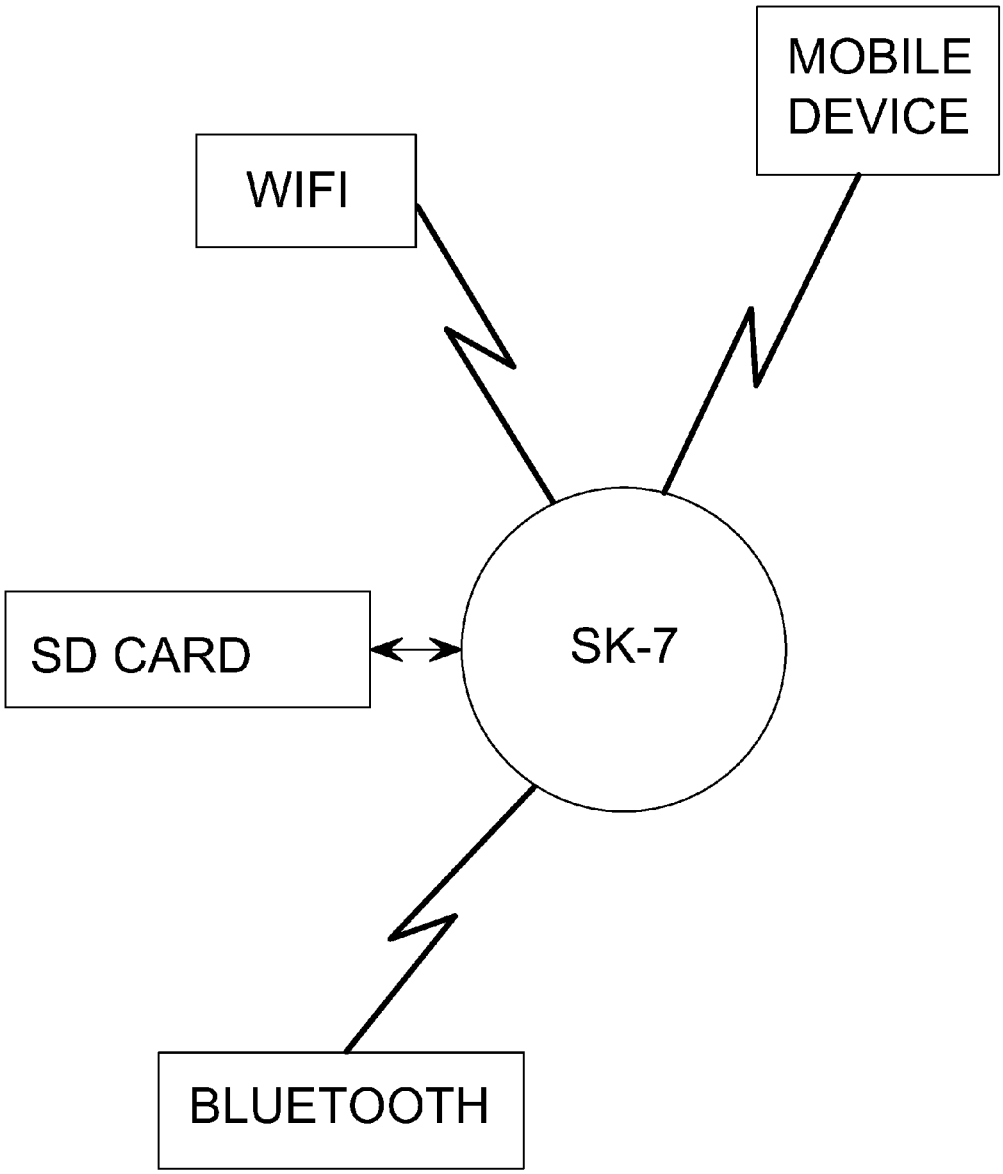
FIG. 6 is a chart of the present invention. The sk-7 will receive its content via Bluetooth or Wi-Fi or a pre loaded micro-SD card.

Referring to FIG. 6, shown is a chart of the present invention. The sk-7 display will receive its content via Bluetooth or Wi-Fi transmitted by mobile device or a pre loaded micro-SD card 42 (seen in FIG. 7). This content could be any number of decorative motifs, or could be used to convey information to the user. For example, if the shoe was being worn by an athlete during a competition, the display could transmit instructions regarding the play or formation desired by the coach. It could provide a schematic of the field showing the location of the opposing team's players. In soccer (or football) for example, the player's attention is often located proximate their feet, so as to make it easy for them to see the display.

The peripheral LEDs could have a safety or decorative purpose. Various colors and patterns could be programmed into a small processor 50 contained within the shoe 10 as will be discussed regarding FIG. 7. Another potential use of the display could be to convey to the user some data regarding their bodily condition, such as pulse, respiration, or the like. This information could be displayed numerically or it could be conveyed otherwise, for example various colors in the display shading towards another as the user's pulse increased. Any number of other datum would occur to the practitioner: weather, GPS data, news updates, etc. These could also be conveyed through a speaker, as will be discussed below.

Figure 7:
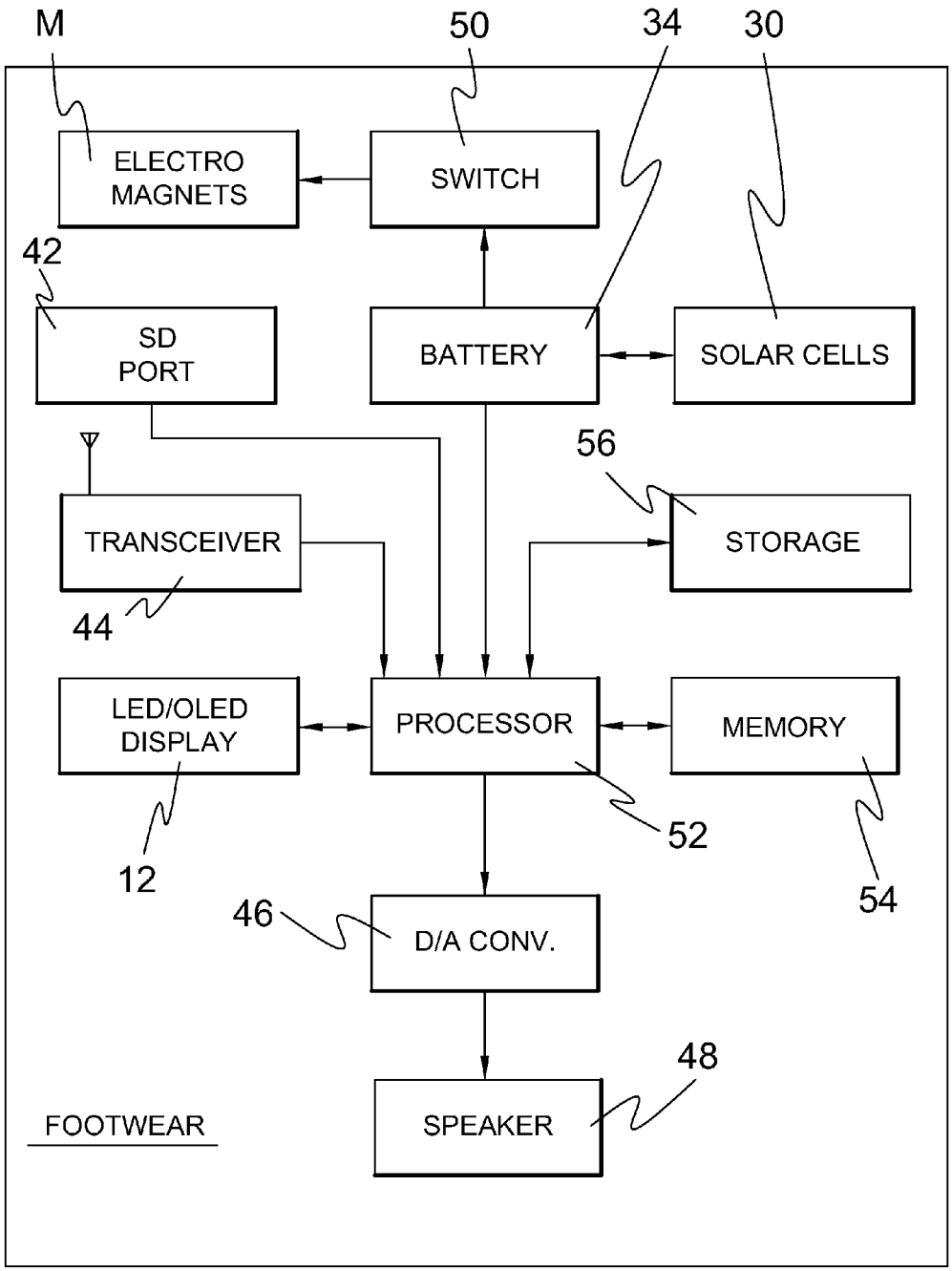
FIG. 7 is a flow chart of the components of the footwear of the present invention.

Referring to FIG. 7, shown is a flow chart of the components of the footwear of the present invention. Data is relayed to processor 52 through an SD card/port 42, a transceiver 44, or it could be stored in memory 54. The processor then sends the required data to display 12 or to speaker 48, in the latter case through D/A converter 46. It should be noted at this point that the LED's seen in the previous Figs. are included in the description of display 12 regarding the discussion of this Figure. Additional, longer term storage of information, patterns, or the like may be held in storage as indicated at 56. Also seen in FIG. 7 is the switch or actuator 50 for the electromagnets M.

The use of the device, in summary, is that the electromagnet switch 50 is thrown, deactivating the magnets M and the first and second deployable sidewalls 16, 18, the deployable tongue 14, and the deployable heel section 28 are moved into the positions seen in FIG. 3 (held in this position by a mating nub and dimple arrangement) thus allowing the user U to insert their foot into the throat T of the novel footwear 10. The deployable sidewalls, tongue and heel section are then moved back into the foot securing position seen in FIGS. 1 and 2, being again held there by another mating nub and dimple arrangement as discussed above and switch 50 is activated, securing the deployable elements further through the relevant electromagnets M. The footwear 10 is powered by a rechargeable battery 34 that provides current to the transceiver 44 and, the display 12, and the memory 54. The battery 34 may be supplemented by solar cells 30 deployed, as is seen in the Figures, preferably upon the tongue 14. All the components thus seen are connected through wires built into the footwear 10. These connections through various moving parts of the footwear 10, specifically the deployable sections of the invention may be achieved by having the wires run through the telescoping rails 36, or through contacts brought into relationship with one another when the deployable elements are in the secure position (FIGS. 1 and 2).

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. Footwear comprising:

an outsole having a lower ground contact portion and a peripheral edge extending thereabout said outsole further including a heel portion;

an upper section substantially constructed of composite carbon fiber connected to said outsole, said upper having a left side, a right side and a top side, and a plurality of apertures extending completely through a surface of said upper section to provide airflow therethrough;

at least one deployable sidewall located on one of said right or left upper sides;

a deployable tongue located on said top side of said upper section;

a power means located within said outsole;

a first display means located on said deployable tongue;

a display means connected to said power means and said first display means such that a user may deploy said deployable sidewall and said deployable tongue to insert a foot into said footwear and a desired display may be directed to said first display means; and a first deployable sidewall on said right side of said upper section and a second deployable sidewall on said left side of said upper section and wherein said first and said second deployable sidewalls include telescopic rails extending therefrom and into corresponding rail receiving apertures located on the peripheral edge of said outsole where said first and said second deployable sidewalls are laterally and outwardly movable to a deployed position.

2. The footwear as claimed in claim 1, wherein said deployable tongue includes telescopic rails extending therefrom and into cooperating rail receiving apertures located within said upper section and where said deployable tongue is upwardly and outwardly movable to a deployed position.

3. The footwear as claimed in claim 2, where said power means is a rechargeable battery located within said outsole and proximate to said heel portion of said outsole.

4. The footwear as claimed in claim 3, further including a transceiver and a processor, said transceiver adapted to receive a remote signal and said processor adapted to process said signal to control said display means.

5. The footwear as claimed in claim 4 wherein said display means is an LED display.

6. The footwear as claimed in claim 4, where said display means is an OLED display.

7. Footwear comprising:

an outsole having a lower ground contact portion and a peripheral edge extending thereabout said outsole further including a heel portion;

an upper section substantially constructed of composite carbon fiber connected to said outsole, said upper having a left side, a right side and a top side, and a plurality of apertures extending completely through a surface of said upper section to provide airflow therethrough;

at least one deployable sidewall located on one of said right or left upper sides;

a deployable tongue located on said top side of said upper section;

a power means located within said outsole;

a first display means located on said deployable tongue;

a display means connected to said power means and said first display means such that a user may deploy said deployable sidewall and said deployable tongue to insert a foot into said footwear and a desired display may be directed to said first display means; and a first deployable sidewall on said right side of said upper section and a second deployable sidewall on said left side of said upper section and wherein said first and said second deployable sidewalls include telescopic rails extending therefrom and into corresponding rail receiving apertures located on the peripheral edge of said outsole where said first and said second deployable sidewalls are laterally and outwardly movable to a deployed position and further wherein said deployable tongue includes telescopic rails extending therefrom and into cooperating rail receiving apertures located within said upper section and where said deployable tongue is upwardly and outwardly movable to a deployed position.

8. The footwear as claimed in claim 7 wherein said deployable tongue further includes solar panels and where said power means is a rechargeable battery located within said outsole and proximate to said heel portion of said outsole and further where said solar panels are adapted to recharge said rechargeable battery.

9. The footwear as claimed in claim 8, further including a transceiver and a processor, said transceiver adapted to receive a remote signal and said processor adapted to process said signal to control said first display means.

10. The footwear as claimed in claim 9 wherein said display means is an LED display.

11. The footwear as claimed in claim 9, where said display means is an OLED display.

12. Footwear comprising:

an outsole having a lower ground contact portion and a peripheral edge extending thereabout said outsole further including a heel portion;

an upper section connected to said outsole, said upper having a left side, a right side and a top side and where said upper section is comprised substantially of a carbon fiber composite material and where said upper section further includes a plurality of apertures extending completely through the surface of said upper section to provide airflow therethrough;

a first deployable sidewall on said right side of said upper section and a second deployable sidewall on said left side of said upper section and wherein said first and said second deployable sidewalls include telescopic rails extending therefrom and into corresponding rail receiving apertures located on the peripheral edge of said outsole where said first and said second deployable sidewalls are laterally and outwardly movable to a deployed position;

a deployable tongue located on said top side of said upper section, said deployable tongue including telescopic rails extending therefrom and into cooperating rail receiving apertures located within said upper section and where said deployable tongue is upwardly and outwardly movable to a deployed position;

a power means located within said outsole;

electromagnetic seals located on each of said deployable side sections, and on said deployable tongue, and on said outsole, said electromagnetic seals being powered by said power means such that the user may activate said electromagnetic seals to prevent inadvertent deployment of said deployable sections;

a first display means located on said deployable tongue; and a display means connected to said power means and said first display means such that a user may deploy said deployable sidewall and said deployable tongue to insert a foot into said footwear and a desired display may be directed to said first display means.

13. The footwear as claimed in claim 12 further including a second display means, said second display means comprising a plurality of LEDs extending about said peripheral edge of said outsole.

14. The footwear as claimed in claim 13 wherein said deployable tongue further includes solar panels and where said power means is a rechargeable battery located within said outsole and proximate to said heel portion of said outsole and further where said solar panels are adapted to recharge said rechargeable battery.

15. The footwear as claimed in claim 14, further including a transceiver and a processor, said transceiver adapted to receive a remote signal and said processor adapted to process said signal to control said first display means.

16. The footwear as claimed in claim 15 wherein said display means is an LED display.

17. The footwear as claimed in claim 15, where said display means is an OLED display.

* * * * *